United States Patent [19]

Watkins

[11] 4,428,433

[45] Jan. 31, 1984

[54] TELESCOPIC JOINT UPPER TUBE RETAINER METHOD

[75] Inventor: Bruce J. Watkins, Palos Verdes Estates, Calif.

[73] Assignee: Hughes Tool Company, Houston, Tex.

[21] Appl. No.: 306,443

[22] Filed: Sep. 28, 1981

[51] Int. Cl.[3] ..... E21B 17/07

[52] U.S. Cl. ..... 166/339; 166/341; 166/345; 166/355

[58] Field of Search ..... 166/82, 84, 339, 340, 166/341, 342, 343, 345, 350, 351, 367, 377, 386; 285/24, 27, 39, 322, 323, 337, 368

[56] References Cited

U.S. PATENT DOCUMENTS

| | | | |
|---|---|---|---|
| 2,517,655 | 8/1950 | Gillespie | 166/82 |
| 2,818,635 | 1/1958 | Carlsen | 29/245 |
| 3,118,692 | 1/1964 | Fitzhugh | 285/322 |
| 3,598,429 | 6/1971 | Arnold | 285/322 |
| 3,791,442 | 2/1974 | Watkins | 285/18 |
| 4,124,231 | 11/1978 | Ahlstone | 285/322 |
| 4,127,289 | 11/1978 | Daspit | 285/322 |
| 4,138,148 | 2/1979 | Zaremba | 166/340 |
| 4,239,266 | 12/1980 | Mynhier | 285/323 |
| 4,300,637 | 11/1981 | Valka | 166/341 |

FOREIGN PATENT DOCUMENTS 2077812 12/1981 United Kingdom ..... 166/341

OTHER PUBLICATIONS

1974–1975 Regan Subsea Drilling & Completion Equipment Brochure.

*Primary Examiner*—Stephen J. Novosad
*Assistant Examiner*—William P. Neuder
*Attorney, Agent, or Firm*—Robert A. Felsman; Guy Porter Smith

[57] ABSTRACT

A telescopic joint inner tube retainer is provided for holding the joint upper tube to a cross over support conduit suspended by a ball and socket conduit connection to a diverter type coupling to a floating vessel or overhead platform wherein retainer has a split internally threaded locking ring engaged about a mating thread on an upper exterior portion of the telescopic joint upper tube, a solid support ring landed upwardly about the split locking ring and means for drawing the solid ring tightly upwardly toward the support conduit with the split locking ring therebetween to suspend the joint upper tube from the support conduit in a manner which can be easily disengaged even if the threaded engagement between the locking ring ad joint upper tube would not otherwise be releasable through relative turning movement of the locking ring and joint upper tube.

3 Claims, 8 Drawing Figures

42
27

66
26
30
64
65
40
59
57
67
VI
VI
39
43
56
50
54
VII
VII
52
60
44
91
41
90
38
31
33

73
27

66
26
64
40
67
65
39
41
56
50
52
70
54
71
44
91
90
72
38
31
33

Fig. 6.
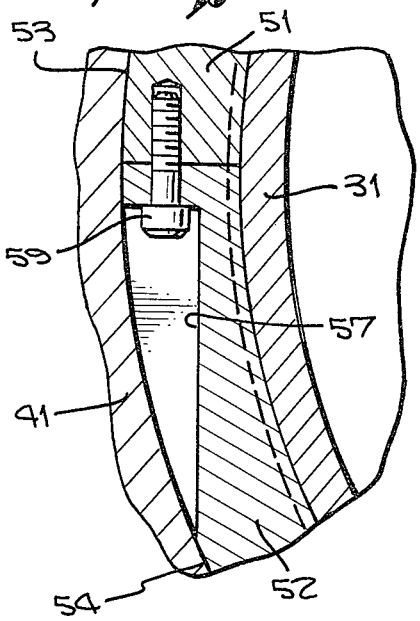
Fig. 7.
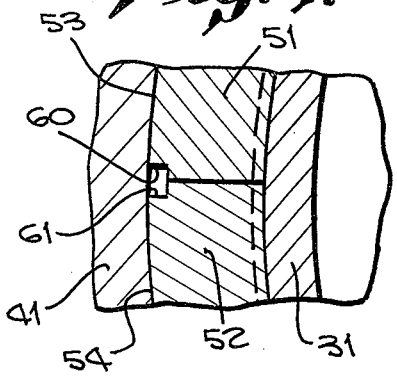
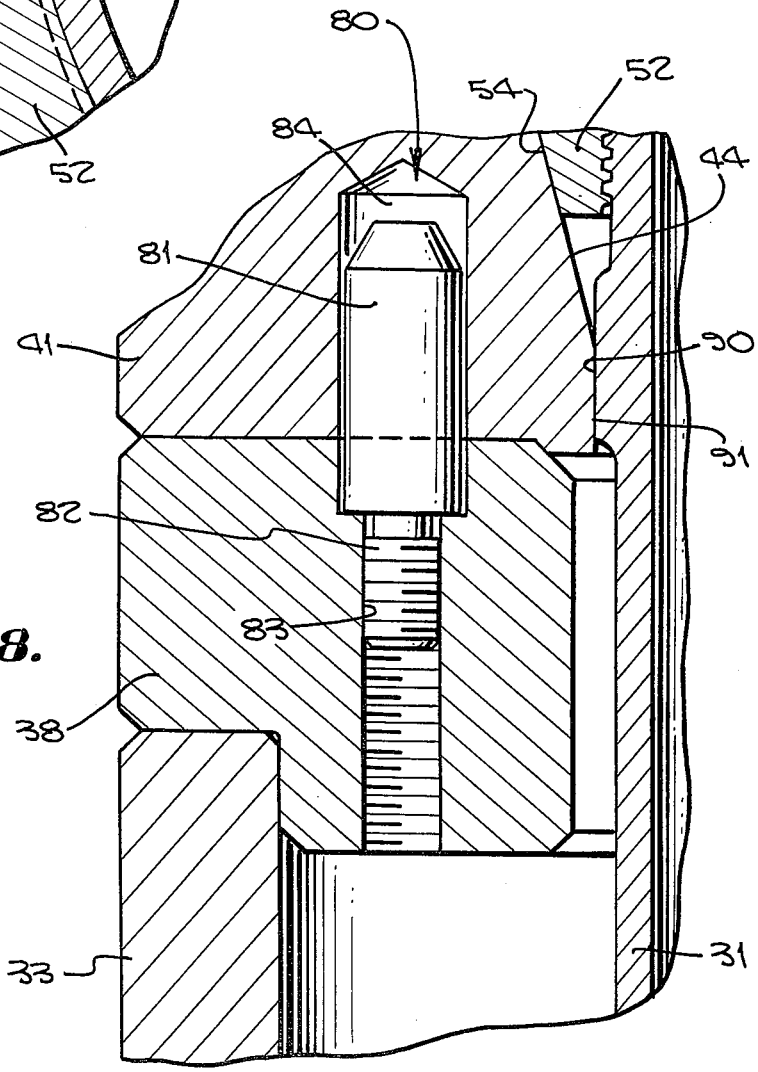
Fig. 8.

TELESCOPIC JOINT UPPER TUBE RETAINER METHOD

BACKGROUND OF THE INVENTION

The present invention relates in general to coupling means for coupling portions of a subsea riser to a floating vessel or overhead platform where a riser connection is made with a subsea well. More particularly, the present invention is directed to a method and apparatus for retaining the upper tube of a telescopic joint in the riser installation to a cross over support conduit secured to the vessel or platform in a manner which facilitates the subsequent disengagement of the joint upper tube therefrom.

In subsea well operations where a riser connection is established between a floating vessel or an overhead platform and a subsea well, as in prior U.S. Pat. No. 3,791,442, it is conventional to employ a telescopic joint wherein major portions of the riser are suspended by riser tensioning means which allow compensating movement of the vessel or platform under wind or sea action relative to the major extent of the riser. As in said U.S. Pat. No. 3,791,442, an upper, usually inner, tube of the telescopic joint is connected to the vessel or platform, which such connection possibly including a ball and socket conduit connection assembly supported from a diverter assembly landed in a support structure beneath the rotary table on the vessel or platform. It has been conventional heretofore to engage the telescopic joint upper tube to a cross over or support conduit suspended from the vessel or platform associated conduits by a threaded engagement between the upper tube and cross over support conduit. However, after continued use of the riser in the corrosive environment of salt water ocean situations it has been found difficult to disengage the telescopic joint upper tube from its associated support conduit to which it is threadably engaged.

It is therefore the primary object of the present invention to disclose and provide a method and apparatus for providing a threaded interengagement between the telescopic joint upper tube and the associated cross over support conduit by which the upper tube is suspended from the overhead vessel or platform in a reliable secure manner and yet will facilitate the subsequent removal of the upper tube of the telescopic joint subsequent to extensive use even if the threaded engagement has become worn or corroded in such a manner as to preclude or inhibit a rotational disengagement.

SUMMARY OF THE INVENTION

Generally stated, the present invention in telescopic joint inner tube retainer finds particular use in a subsea well installation wherein a telescopic joint is provided in a riser run from an overhead floating vessel to the subsea well, the telescopic joint having an upper conduit to be attached to a support conduit suspended from the vessel, the retainer including a separable multi-parted locking means for securely engaging and locking about a portion of the upper conduit in a tight locked fit preventing relative axial movement between a locking means and the upper conduit, a retainer means removably mounted relative to the locking means for supporting and retaining the locking means about the conduit and fastening means for drawing the retainer means upwardly about the locking means toward the support conduit with the locking means disposed between the retaining means and support conduit.

More specifically, the multi-parted locking ring comprises a split annular ring having an outer downwardly and radially inwardly tapered exterior surface and a threaded internal surface to threadably engage about the upper conduit, the retainer means includes a solid annular retainer ring having an inner tapered bore of inverted conical configuration provided to matingly engage and wedgingly confine and support the locking ring parts to and about the upper conduit, and guide surfaces are provided between the retainer ring and upper conduit which cooperate with said tapered surfaces for guiding movement of said retainer ring when it is drawn toward the support member, preferably by tensioning bolts run through a flange of the support member and threadably engaging in the retainer ring.

In accordance with the method of the present invention, the upper tube of the telescopic joint is attached to the suspension member mounted to the floating vessel or overhead platform generally by the steps of fitting a split internally threaded ring about an upper externally threaded portion of the telescopic joint upper tube and landing a solid support ring about the split ring by rising the solid ring upwardly about the split ring through tighting of fastening means extending from the suspension member to the support ring. The split ring is preferably preassembled to the upper tube and held thereon by fastening means engaging the split halves of the locking ring and holding them together preparatory to the step of landing the solid support ring thereabout. By removing the solid support ring when it is desired to release the telescopic joint upper tube, the threaded engagement between the internally threaded split locking ring and the telescopic joint upper tube may be released by removal of the fastening means holding the two ring halves in assembled relationship and prying the ring halves apart to disengage the threads without a relative rotational movement between the locking ming parts and the upper tube.

It is believed that a better understanding of the present invention in telescopic joint inner tube retainer method and apparatus will be attained by those skilled in the art, as well as a recognition of additional objects and advantages afforded, by the following detailed description of a preferred exemplary embodiment thereof. Reference will be made to the appended sheets of drawings which will be first briefly described.

BRIEF DESCRIPTION OF THE DRAWINGS

FIG. 6 is a detail horizontal section view of a portion of the retainer of FIG. 4 taken therein along the plane VI—VI.

FIG. 7 is a detail section view of the retainer of FIG. 4 taken therein along the plane VII—VII.

FIG. 8 is a detail section view of the retainer of FIG. 2 taken therein along the plane VIII—VIII.

DESCRIPTION OF A PREFERRED EXEMPLARY EMBODIMENT

Figure 1:
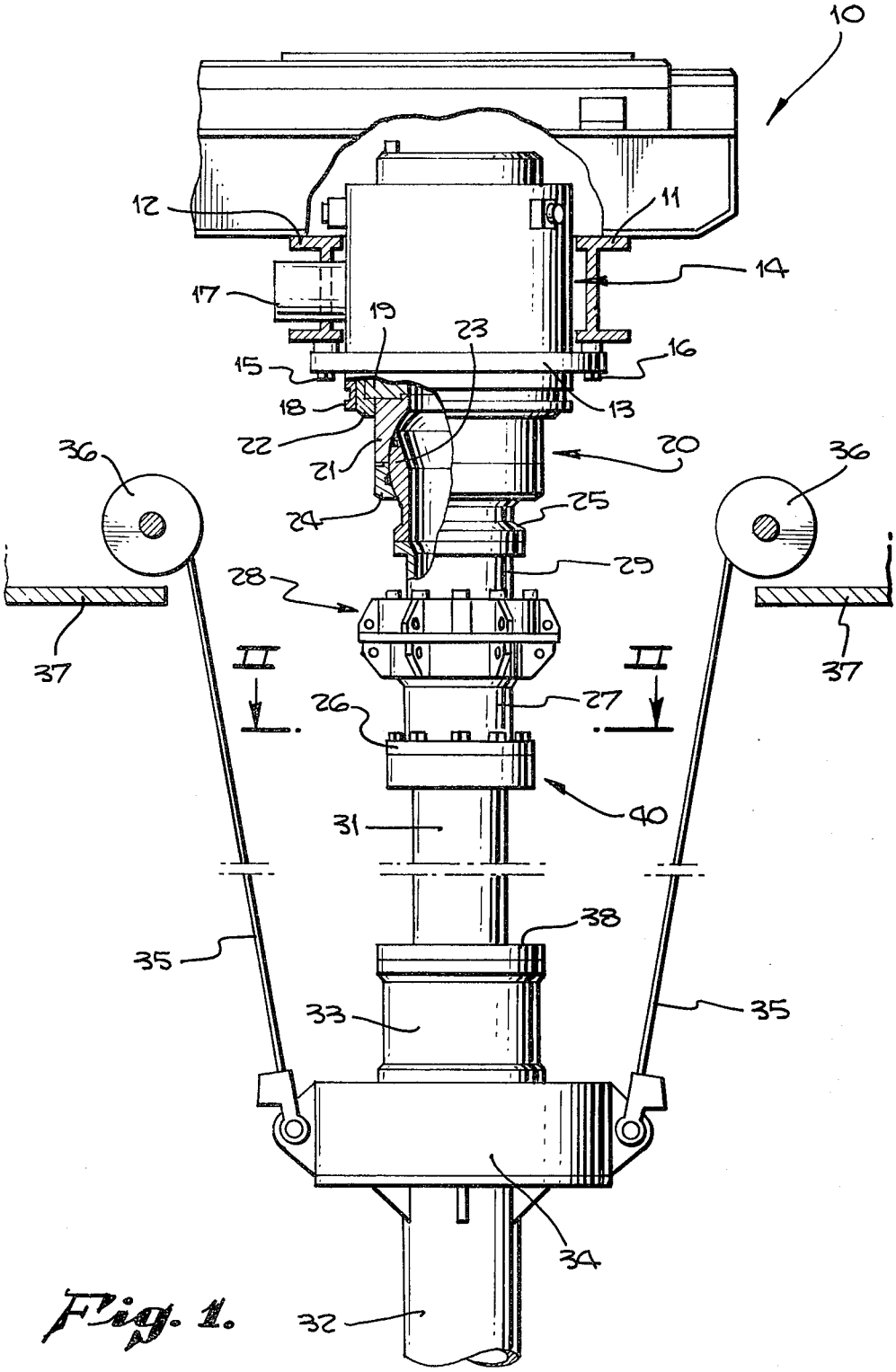
FIG. 1 is an exemplary view of portions of a riser connection between a floating vessel and subsea well showing a telescopic joint having an upper inner tube suspended by an exemplary embodiment of telescopic joint inner tube retainer in accordance with the present invention.

Referring now initially to FIG. 1, a rotary table, indicated generally at 10, is illustrated which may be mounted to a floating vessel or overhead platform above a subsea well. A subframe including I-beams 11 and 12, is connected to support flange 13 of a diverter assembly 14 by bolts 15 and 16 in somewhat the same fashion as is the coupling means of the prior U.S. Pat. No. 3,791,442 entitled COUPLING MEANS FOR A RISER STRING RUN FROM A FLOATING VESSEL TO A SUBSEA WELL, the disclosure of which is incorporated herein by reference. As is now conventional in such diverter assembly installations, the diverter assembly 14 is provided with a mud return passage 17 for connection to mud return reservoirs, has a side wall 18 defining a cavity in which the diverter insert 19, may be landed as in said U.S. Pat. No. 3,791,442. A ball and socket joint, indicated generally 20, is suspended from the diverter insert 19 with the top socket half 21 bolted into insert 19 or otherwise fastened thereto. Diverter insert 19 may be bolted or otherwise fastened to a support ring 22 landed in known manner within diverter assembly 14. The ball 23 of the ball and socket joint is mounted by the lower socket half 24 and is formed as part of a short conduit member having a bottom flange 25.

As will be discussed more fully hereinafter, the exemplary embodiment of telescopic joint inner tube retainer, indicated generally at 40, connects the upper telescopic joint inner tube 31 to a flange 26 of a cross-over or support conduit member 27 secured by a conventional conduit coupling indicated generally at 28 to stub conduit 29 welded, bolted or otherwise secured to the ball conduit unit 23. The cross-over or support conduit member 27 functions to hold the upper tube 31 of the telescopic joint in the riser assembly to the vessel or platform rotary table via the ball and socket joint indicated generally at 20 and the vessel coupling means provided by diverter assembly 14.

As is also seen in FIG. 1, and is otherwise conventional in subsea well operations, the lower tube or conduit 32 of the telescopic joint comprises an upper conduit portion of the riser which runs to the subsea well, tube 32 being connected to a packing housing 33 containing suitable packing for sealing the sliding fit between upper, inner tube 31 and lower, outer tube 32. The riser is supported in known manner by tensioning means including the provision of a support frame 34 secured to the upper conduit 32 of the riser, which is the lower tube of the telescopic joint, with frame 34 being suspended by cables 35 run over constant tensioning winches depicted at 36 on a structural portion 37 of the floating vessel or overhead platform. The environment in which the telescopic joint inner tube retainer, indicated generally at 40, thus far described is consider exemplary of the environment in which the present invention finds particularly suitable use.

Figure 2:
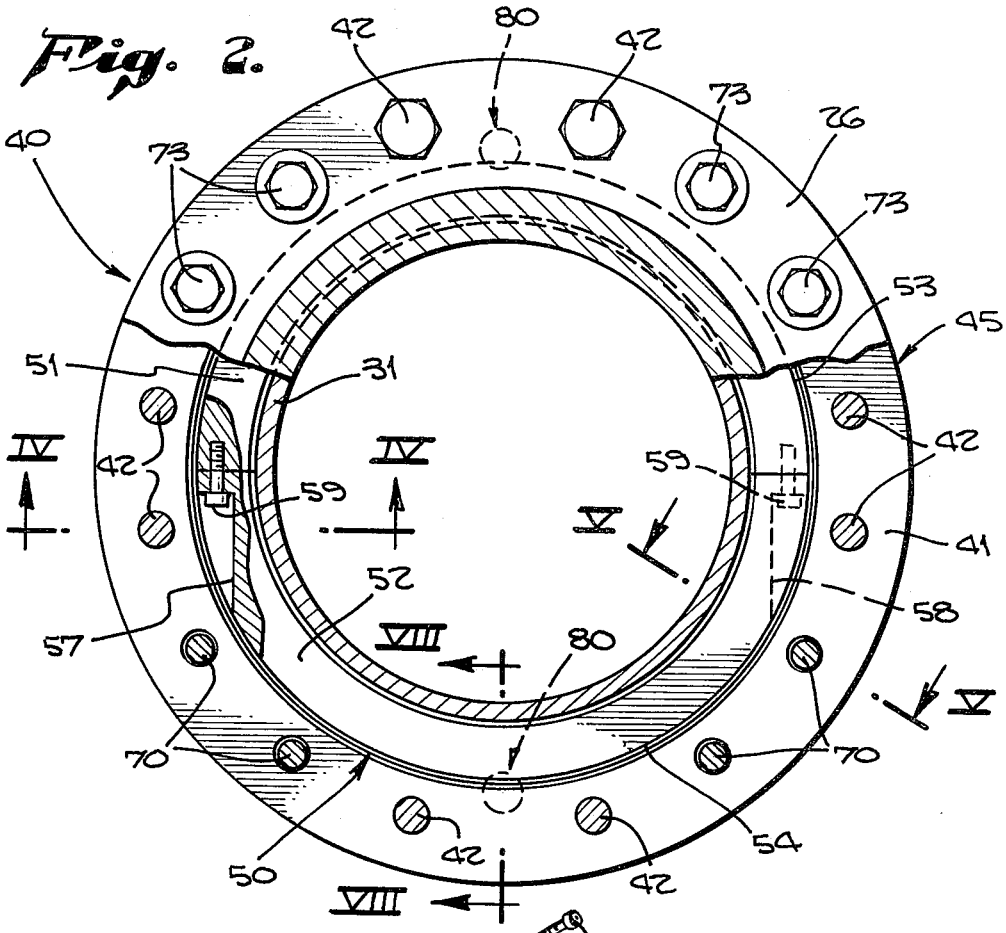
FIG. 2 is a horizontal view, partially in section, of the exemplary embodiment of telescopic joint inner tube retainer of FIG. 1 taken therein along the plane II—II.
Figure 3:
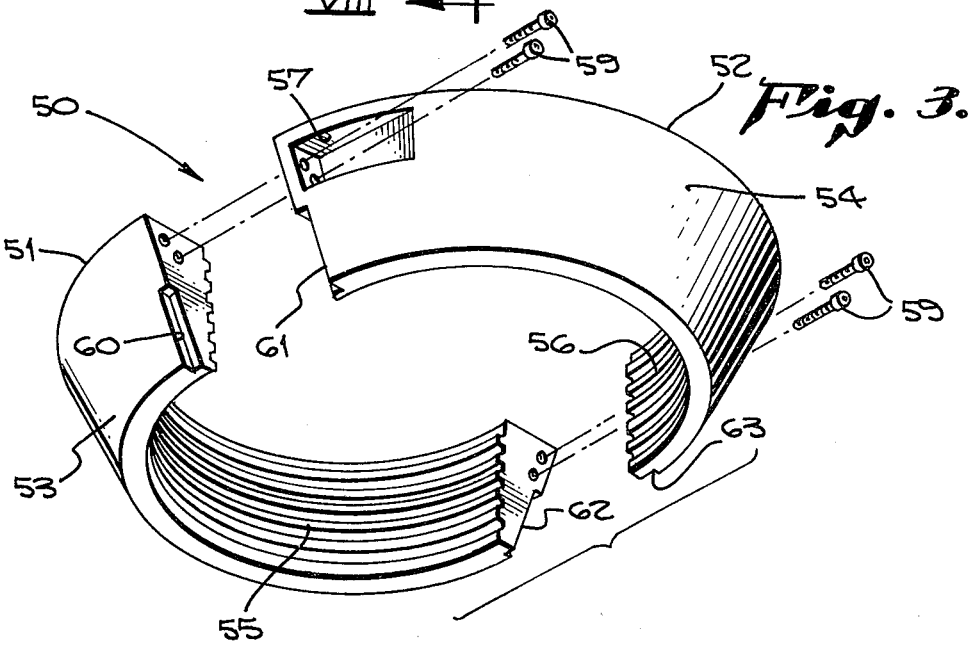
FIG. 3 is an exploded view of an exemplary split locking ring employed in the exemplary embodiment of telescopic joint inner tube retainer of FIGS. 1 and 2.
Figure 4:
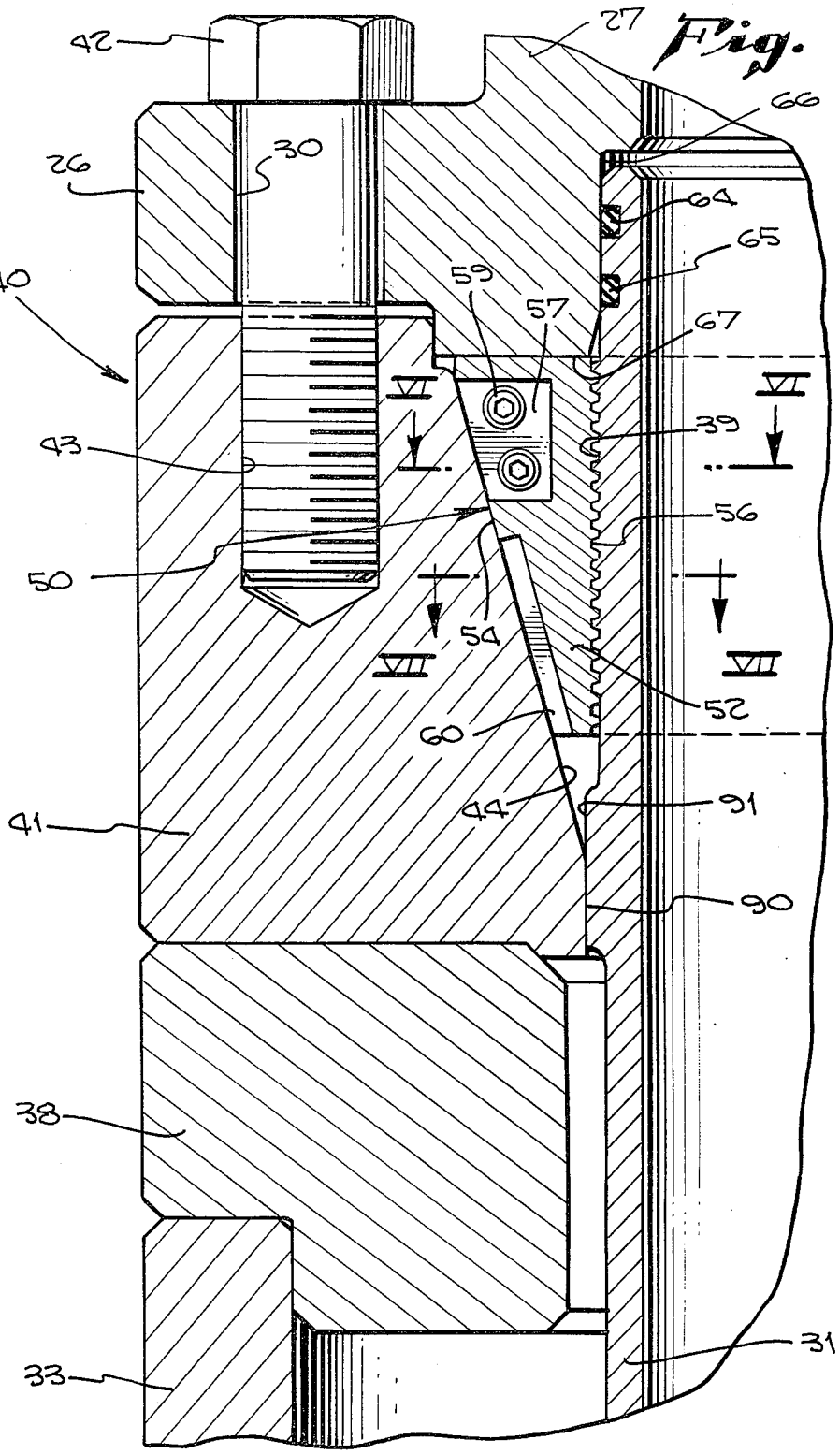
FIG. 4 is a vertical section view of the exemplary embodiment of retainer of FIG. 2 taken therein along the plane IV—IV.

Referring now to FIGS. 2, 3 and 4, the preferred exemplary embodiment of the telescopic joint inner tube retainer is indicated generally at 40 and includes a separable, multi-parted, locking means, which in the exemplary embodiment includes the split locking ring or nut indicated generally at 50 and retainer means for removably mounting the locking means to the telescopic joint inner tube 31, which retainer means in the exemplary embodiment including the solid retainer ring 41. As best seen in FIG. 4, retainer ring 41 is formed of a solid annular configuration and is adapted to be bolted upwardly against cross over or support conduit flange 26 by bolts 42 which penetrate flange bores 30 to threadably engage in vertically opening threaded bores 43 in the retainer ring 41. The inner surface 44 of solid retainer ring 41 is tapered to provide an inverted conical bore configuration, surface 44 diverging radially outwardly as it progresses upwardly as seen in FIG. 4.

Figure 5:
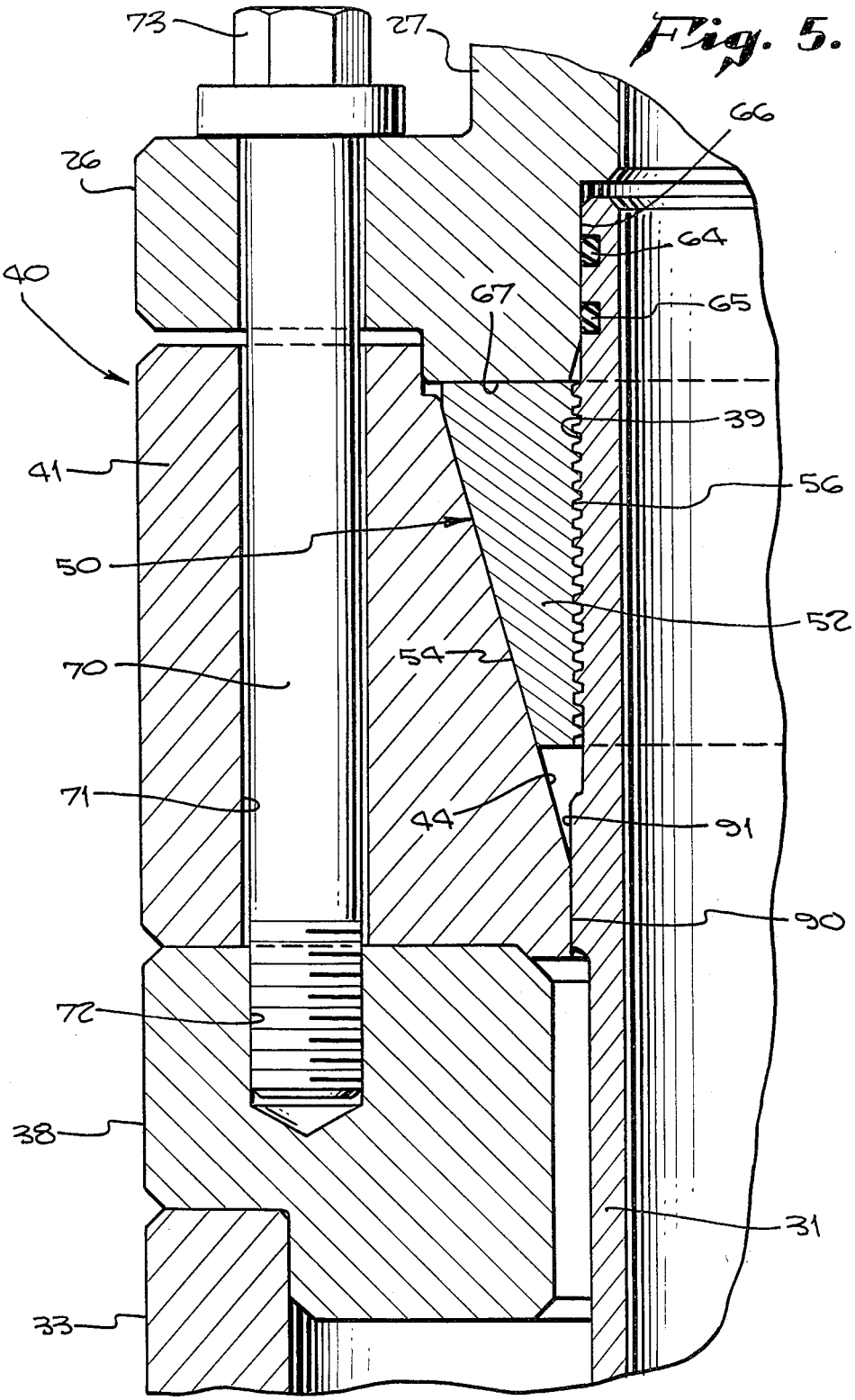
FIG. 5 is a vertical section view of the retainer of FIG. 2 taken therein along the plane V—V.

The separable multi-parted locking means, indicated generally at 50, and as best seen in FIG. 3, comprises in the exemplary embodiment a split annular locking ring including a first ring half 51 and a second ring half 52, the assembly of the two ring half producing an annular locking ring or nut of inverted, truncated and centrally bored conical configuration having an outer surface, provided by surfaces 53 and 54 on the two halves, which is tapered in an axially upwardly and radially outwardly divergent manner as seen in FIG. 4. A preferably stub acme left hand thread is provided on the interior of the locking ring as can be seen by threads 55 and 56 in FIG. 3. One of the ring halves, as ring half 54, is provided with bolt receiving recesses 57 and 58 which receive bolts 59 which are adapted to thread into the mating ring half 51 to allow preassembly of the locking ring about an upper portion of the telescopic joint inner tube 31 as seen in FIG. 4 with the locking ring internal threads 55 and 56 in mating engagement with the preferably stub acme left handed threads 39 provided on an upper portion of tube 31 as seen in FIGS. 4 and 5. Pry bar recesses 60, 61, 62 and 63 are provided in the locking ring halves as seen in FIG. 3 to facilitate prying the locking ring off of the tube 31 when it is desired to release tube 31 from the cross over or support member 27.

Suitable sealing O-ring seal 64 and 65 may be provided about an upper end of inner tube 31, as seen in FIG. 4 to seal against bore 66 of the support member 27. As is also seen in FIG. 4, an abutment surface 67 of annular configuration is formed on the lower end of support member 27 about bore 66 against which the upper surface of the locking ring means indicated generally at 50, abuts when tube 31 is held in fluid tight secure assembled relation to support member 27.

While the telescopic joint including inner tube 31 and outer tube 32 are shown in a telescoping relation in FIG. 1, it may be desirable to lock the joint against telescopic movement in various stages of running or withdrawing the riser connection to the well. As best seen in FIG. 5, bolts 70 may be provided to pass through bores 71 in solid retainer ring 41 to engage in threaded bores 72 provided in the top flange 38 of the telescopic joint packing housing 33. In addition, orienting means, indicated generally at 80 in FIG. 8, may be provided in the exemplary embodiment for locating the retainer ring 41 upon flange 38 preparatory to bolting the two together via bolts 70. One or more orienting pins may be provided, as pin 81 in FIG. 8, which can be attached to the flange 38 via threaded extensions as threaded extension 82, to threaded bores, as bore 83, in flange 38. Pin receiving bores, as bore 84, may be provided in the solid retainer ring 41 to receive the retainer pins in orienting the retainer ring 41 to flange 38 in a desired manner.

As can be seen from the foregoing, the method and apparatus of the present invention in telescopic joint inner tube retainer provides for the fitting of the split internally threaded locking ring halves 51 and 52 about an upper exteriorly threaded portion of the inner, upper tube 31 of the telescopic joint. The ring halves may be held in such assembled relation by means of recessed bolts 59 which do not interfere with the functioning of the exterior tapered surfaces 53 and 54. As seen in FIGS. 4 and 5, the solid support ring 41 has an inner abutment surface 90 which rides against a circumferential, radially protruding abutment surface 91 of inner tube 31 in a lower region of ring 41. Retainer ring 41 may be landed upwardly about the split locking ring, indicated generally at 50, by being pulled upwardly by bolts 42, guided by the alignment of abutment surfaces 90 and 91 with inner tapered surface 44 engaging and wedging against outer tapered surfaces 53 and 54 of the locking ring. Bolts 42 may be turned sufficiently tight to draw solid ring 41 upwardly to tightly secure the split locking ring means indicated generally 50 to tube 31 and to hold the locking ring and tube 31 securely to and in sealed aligned engagement in bore 66 of the support member 27.

Having thus described a preferred exemplary embodiment of telescopic joint inner tube retainer in accordance with the present invention in the environment of a subsea riser installation run from a floating vessel or overhead platform to a subsea well, it should now be apparent to those skilled in the art that the retainer of the present invention attains the objects and advantages stated hereinbefore. The telescopic joint inner tube 31 may be securely suspended from the cross over or support member 27 during riser operations and when it is desired to remove the upper tube 31 from the installation, it may be easily removed by the loosing of bolts 41, the removal of solid ring 41 from about the split locking ring indicated generally at 50, and the ring parts 51 and 52 may be separated from the threaded engagement with tube 31 by the removal of bolts 59 and, if necessary, use of a pry bar via notches 60 through 64. It should also be understood by those skilled in the art that various other embodiments, modifications and adaptations of the present invention in telescopic joint inner tube retainer may be made within the scope of the present invention which is defined by the following claims.

I claim:

1. A method of assembling the upper tube of a telescopic joint to a suspension member attached to a floating vessel over a subsea well wherein the telescopic joint comprises part of a riser connection between the vessel and well, the method comprising the steps of:

fitting a split internally threaded locking nut about an upper externally threaded portion of said upper tube;

landing a solid support ring about said split nut by raising said solid ring upwardly about said split nut by pulling said solid ring upwardly against said suspension member with said split nut therebetween.

2. The method of claim 1 wherein said step of fitting a split internally threaded nut about an upper externally threaded portion of said upper tube includes the step of fastening said split nut in place on said upper tube in a preassembly thereof preparatory to the step of landing said solid support ring upwardly thereabout.

3. A method of assembling and disassembling the upper tube of a telescopic joint to a suspension member attached to a floating vessel over a subsea well wherein the telescopic joint comprises part of a riser connection between the vessel and well, the method comprising the steps of:

fitting a split internally threaded locking nut about an upper externally threaded portion of said upper tube;

landing a solid support ring about said split nut by raising said solid ring upwardly about said split nut by pulling said solid ring upwardly against said suspension member with said split nut therebetween; and to disassemble removing said solid support ring downwardly from about said split nut and removing said split nut by prying parts thereof apart from one another to release said upper tube.

* * * * *